United States Patent [19]

Lynch

[11] Patent Number: 5,000,440

[45] Date of Patent: Mar. 19, 1991

[54] TREADMILL EXERCISE DEVICE COMBINED WITH WEIGHT LOAD

[76] Inventor: Robert P. Lynch, 10177 S. 77th E. Ave., Tulsa, Okla. 74133

[21] Appl. No.: 478,059

[22] Filed: Feb. 7, 1990

Related U.S. Application Data

[63] Continuation of Ser. No. 292,886, Jan. 3, 1989, abandoned.

[51] Int. Cl.[5] ..... A63B 22/02

[52] U.S. Cl. ..... 272/69; 272/117; 272/130; 272/136

[58] Field of Search ..... 272/69, 70, 70.3, 73, 272/116, 117, 122, 123, 134, DIG. 9, 129, 130, 136, 138, 142

[56] References Cited

U.S. PATENT DOCUMENTS

| | | | |
|---|---|---|---|
| 219,439 | 9/1879 | Blend | 272/70 |
| 3,850,431 | 11/1974 | Winans | 272/118 |
| 4,334,677 | 6/1982 | Tata | 272/70 X |
| 4,336,934 | 6/1982 | Hanagan et al. | 272/117 X |
| 4,344,619 | 8/1982 | Szabo | 272/117 |
| 4,582,320 | 4/1986 | Shaw | 272/134 X |
| 4,591,147 | 5/1986 | Smith et al. | 272/69 |
| 4,621,810 | 11/1986 | Cummins | 272/117 X |
| 4,625,962 | 12/1986 | Street | 272/132 |
| 4,634,127 | 1/1987 | Rockwell | 272/118 X |
| 4,659,077 | 4/1987 | Stropkay | 272/69 X |
| 4,687,195 | 8/1987 | Potts | 272/69 |
| 4,708,338 | 11/1987 | Potts | 272/70 |
| 4,923,192 | 5/1990 | Sawdon | 272/70 |

*Primary Examiner*—Robert Bahr

*Attorney, Agent, or Firm*—Head & Johnson

[57] ABSTRACT

This is an exercising device combining a treadmill with an upper body muscle stressing device. An upright frame is supported from the base of the treadmill. A weight support frame is pivotally attached to the upper end of such frame. Weights are supported from the exercising frame. The exerciser lifts up on the exercising frame while weights exert a downward force. At the same time, the exerciser is using the treadmill to obtain aerobic level exercise.

5 Claims, 6 Drawing Sheets

TREADMILL EXERCISE DEVICE COMBINED WITH WEIGHT LOAD

This is a continuation of copending application Ser. No. 07/292,886 filed in Jan. 3, 1989, now abandoned.

BACKGROUND OF THE INVENTION

1. Field of the Invention

This invention relates to exercising devices.

2. Background

Treadmill exercising machines are well known and basically consist of a relatively wide endless belt. By walking on this belt one may be obtained aerobic level exercise. Some of these machines are powered by electrical motors and the speed is set at a desired rate for the exerciser. Other treadmills are not powered and the exerciser provides the motivating force. The general objective of these devices is to provide the cardio-pulmonary benefits of jogging or running. This type of physical conditioning is commonly known as aerobic. Treadmills may be set at a horizontal or level position or they may be inclined to cause more difficult exercise.

SUMMARY OF THE INVENTION

In a broad sense, this invention is an exercising device which includes a treadmill and an upper body muscle exercising means supported from that treadmill. By using this device I can provide aerobic conditioning combined with a system for strengthening the upper body muscle groups. The treadmill can be provided with means to incline it to a selected inclination. The exercising device comprises an inclinable treadmill and a pair of handlebars which are pivotally connected to the frame which supports the treadmill. Weights or other means can be added to the end of the handlebars so that a vertical load may be exerted thereon. The treadmill may be powered by a motor so that it can be run at a selected speed or the treadmill can be undriven and be powered by the movement of the exerciser. The treadmill is inclinable so as to be able to vary the angle at which the exerciser is subjected to as he moves along on the treadmill.

A cross bar may connect the ends of the handlebars so as to give the exerciser another mode of exercising the upper body. A still further modification is placing the first set of handlebars at about waist height and placing a second set which is fixed to the first set at a height which would be about shoulder height or higher. This would give a still third group of muscles exercise. The upper set of handlebars enables the operator to lift the load by pushing in an upward position as opposed to lifting which is done with the first set of handlebars. Means are also provided to prevent the handlebars from dropping below essentially a horizontal position. Hydraulic/pneumatic cylinders or springs may also be sued in lieu of the weights.

It is thus a main object of this invention to provide an exercising device that will simultaneously provide aerobic conditioning and upper body muscle exercising.

It is a still further object of this invention to provide an exercising apparatus which allows different sets of upper level muscle groups to be exercised while obtaining the aerobic type exercise benefits.

DETAILED DESCRIPTION

Figure 1:
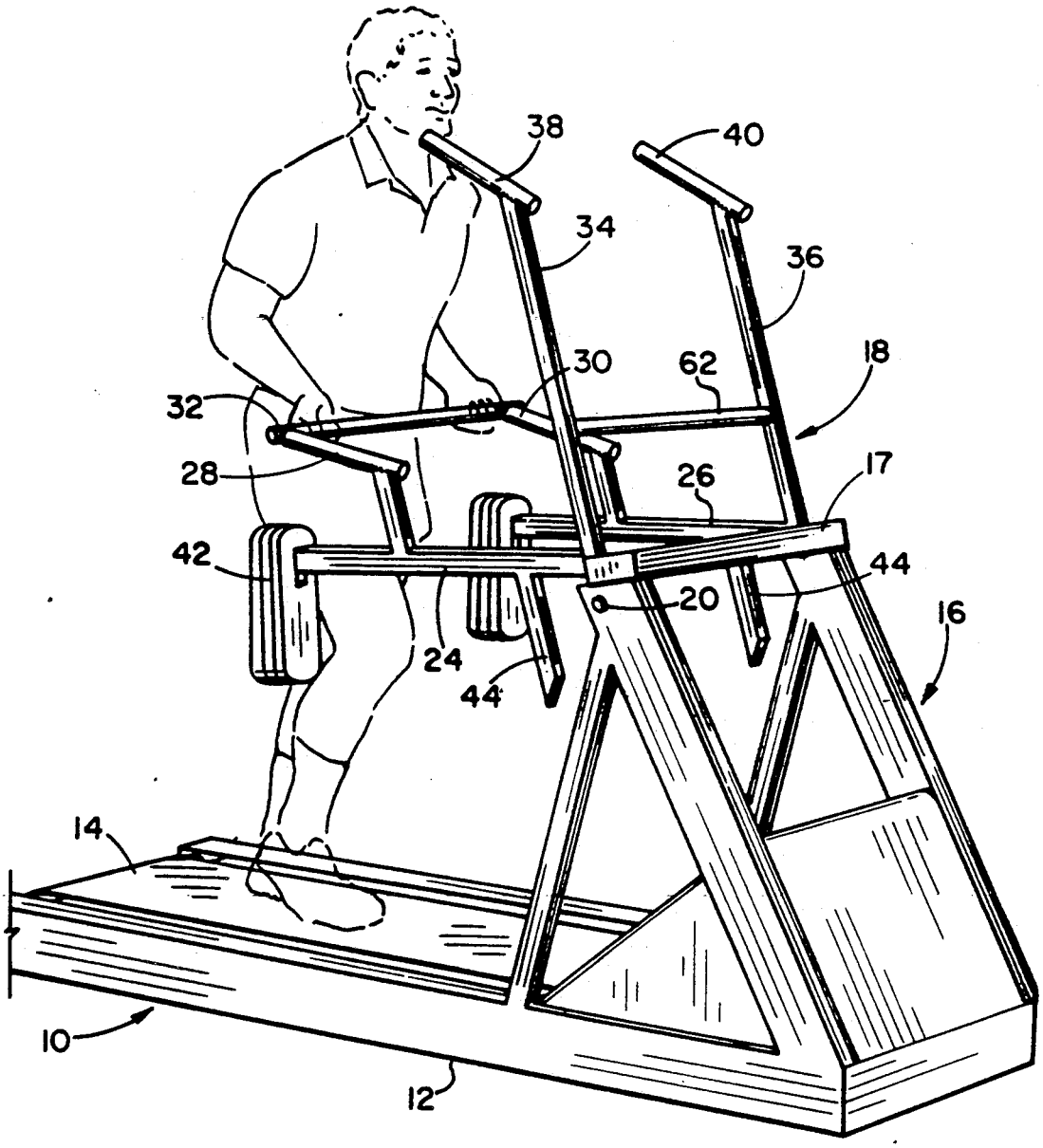
FIG. 1 is an isometric drawing showing my basic invention providing both aerobic and upper body exercise benefits.

Attention is first directed to FIG. 1 which shows an isometric view of the exercising device of my invention. Shown thereon is a treadmill 10 which includes an endless belt 14 upon which the exerciser jogs and a base frame 12. Supported from the base frame is upright support frame 16. A cross support bar 17 extends across the top of frame 16. The treadmill can be either horizontal or level as shown in FIG. 1 or it can be inclined to various positions to give the exerciser various degrees of effort in moving at a selected speed. As is well known, by modifying the inclination one can help the jogger obtain the desired heart rate. Further, the endless belt 14 can be driven by the power of the jogger or it can be propelled by a motor at a selected speed. This treadmill portion of the device of FIG. 1 is designed to give the exerciser aerobic benefits of the exercising.

I shall now discuss that feature of FIG. 1 which provides the devices which permits isometric type exercise of the upper body muscles. Shown thereon is an upper body muscle exercising frame 18 which is pivotally supported at 20 from the upright support frame 16. The upper body muscle exercising means 18 includes a first handlebar 24 and a second handlebar 26. Use of these handlebars permit a lifting exercise. A stop 44 on each handlebar 24 and 26 limits the downward rotation of these handlebars about pivot 20. Handlebars 24 and 26 are each provided with weights 42 to provide the downward force.

Figure 6:
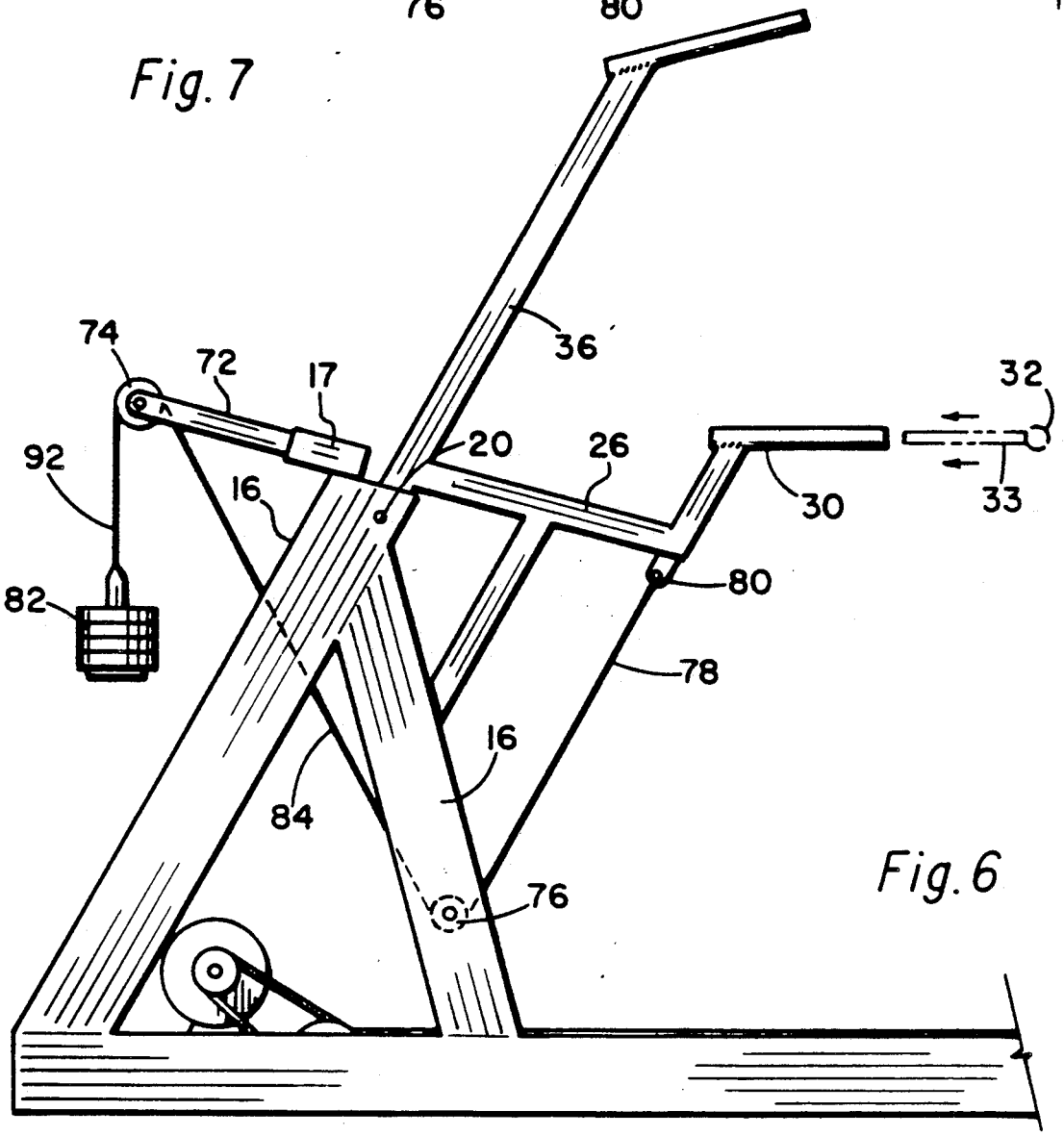
FIG. 6 is a side view of the exercising device showing another way of applying a downward force to the exercising device.

Handlebars 24 and 26 include handle grips 28 and 30 respectively. As shown in FIG. 1, a cross bar 32 is releasably connected to handle grips 28 and 30. Each end of cross bar 32 is provided with a small support rod 33 which is insertable into hand grips 30 and 28 as schematically illustrated in FIG. 6. The exerciser is shown as gripping the cross bar 32 and lifting up. When in this position, the exerciser is obtaining both aerobic exercises on the treadmill 10 and is obtaining upper body strengthening exercises by lifting up on cross bar 32. The amount of effort required to lift up the cross bar 32 so that the stops 44 are not in contact with the support 16, depends upon the amount of weights 42 added. Clamping means, pins, etc. may be used to hold the weights in place. As will be seen, the treadmill 10 can be self-powered by the runner or it can be motor driven. Further, the treadmill can be horizontal as indicated in FIG. 1 or it can be inclined.

Sometimes it is desired to push up with the arms shoulder high or higher in order to exercise another group of muscles. There are means provided in this device to obtain that. This includes third and fourth handlebars 34 and 36 which are a part of the muscle exercising frame 18 and are also connected to handlebars 24 and 26 so that they all rotate about pivots 20 and 22. The handlebars 34 and 36 are in more of a vertical position than are the handlebars 24 and 26. At the top of these handlebars are included a fist upper handle grip 38 and a second upper handle grip 40, respectively. A cross bar 62 connects the handlebars 34 and 36.

Figure 2:
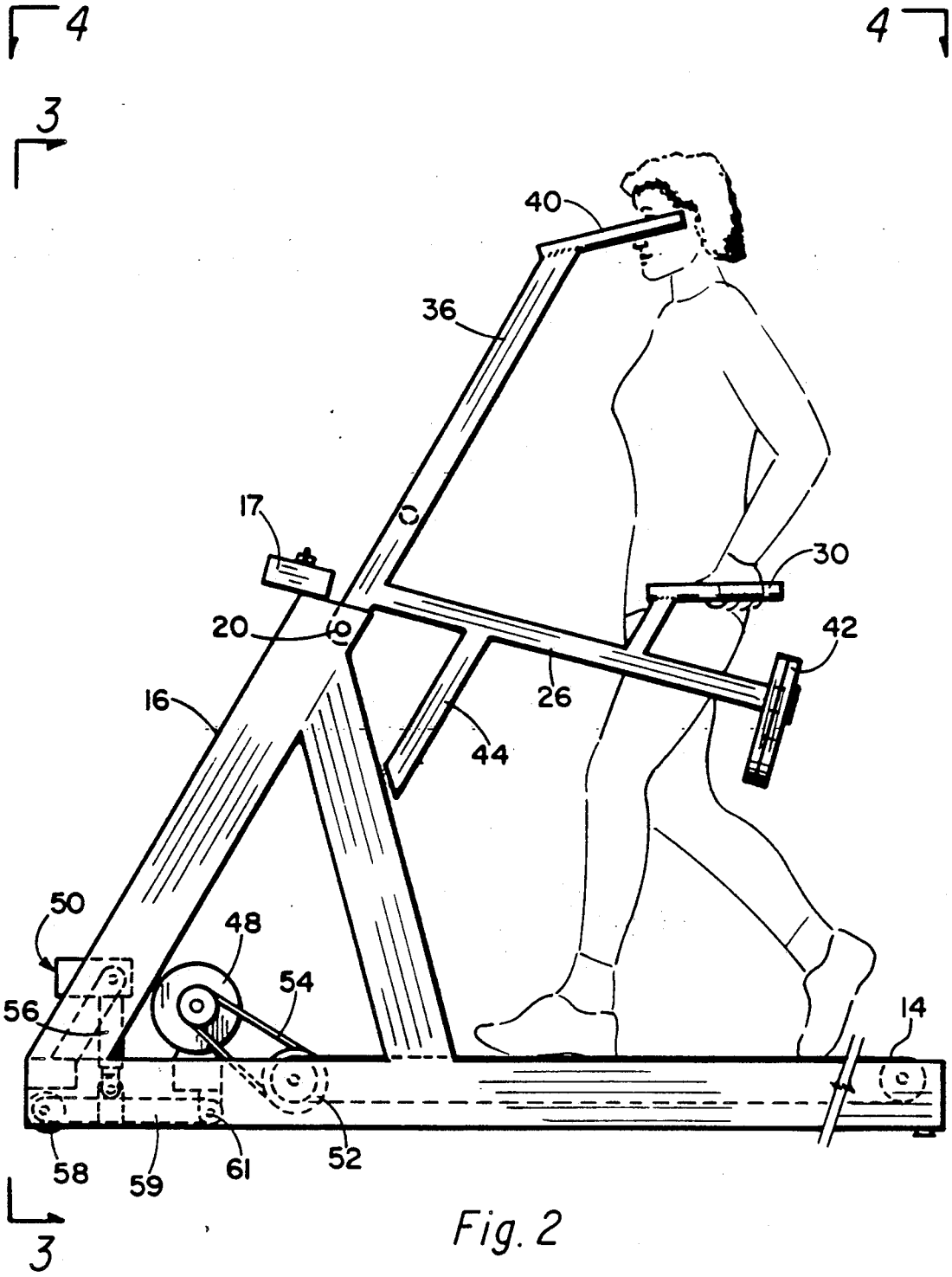
FIG. 2 is a side view of the exercising device of FIG. 1 showing power means to drive the treadmill and an exerciser exercising a different upper body group of muscles from that being exercised in FIG. 1.
Figure 3:
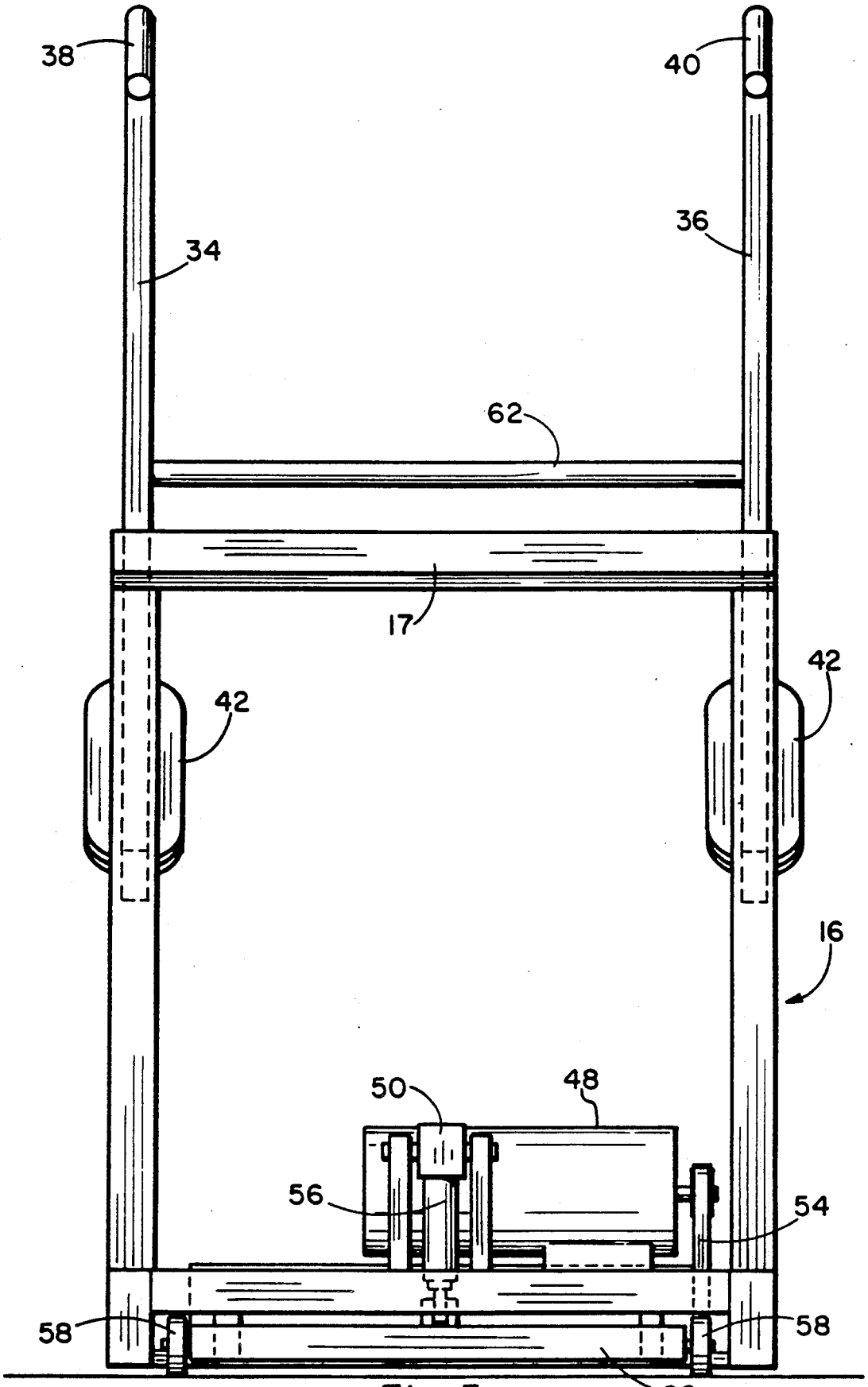
FIG. 3 is a view taken along the line 3—3 of FIG. 2.
Figure 4:
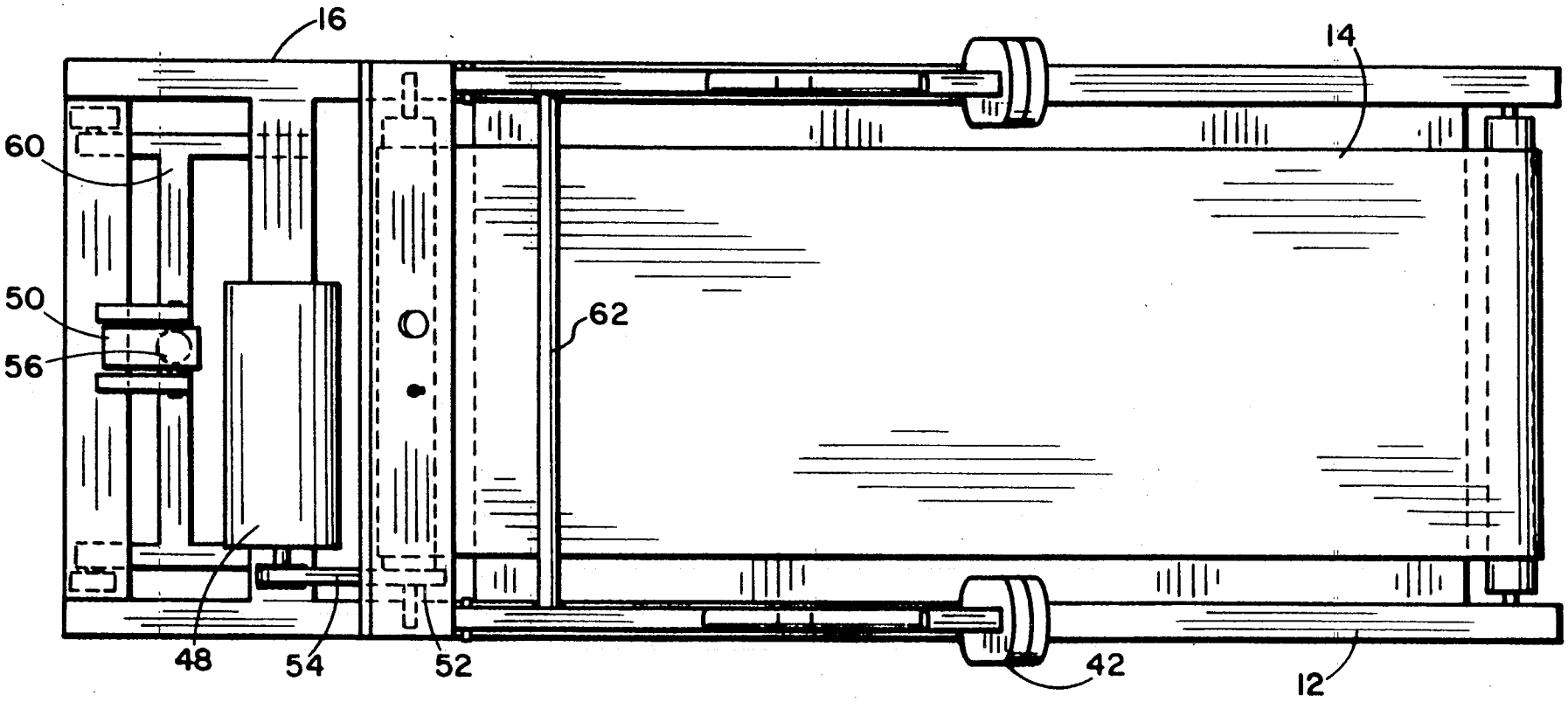
FIG. 4 is a view taken along the line 4—4 of FIG. 2.
Figure 5:
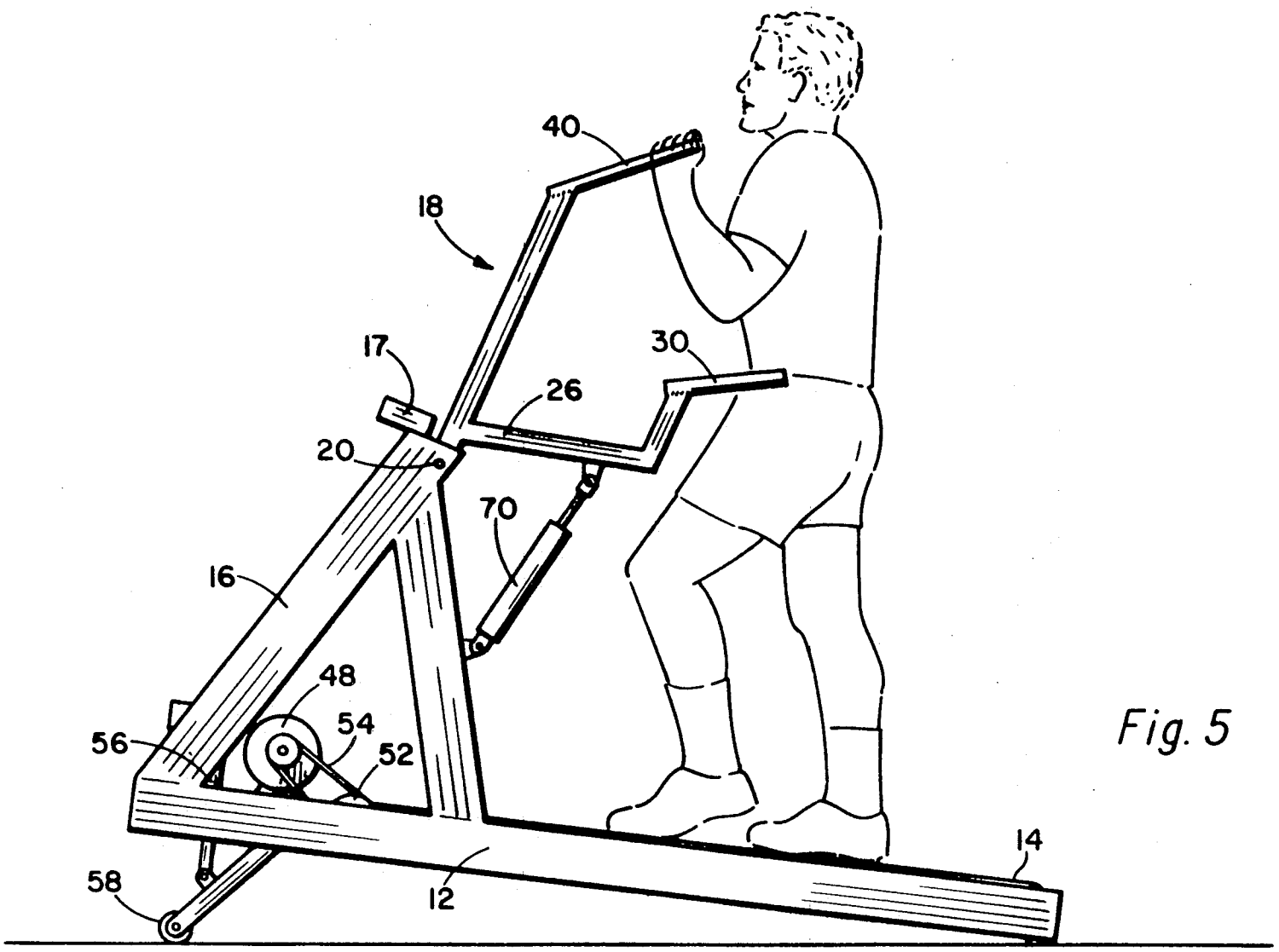
FIG. 5 shows the device of FIG. 2 with the treadmill in an inclined position, a hydraulic type cylinder supplying the vertical resistance instead of weights and an exerciser using the upper handle bars to exercise still another group of muscles.

Attention is next directed to FIG. 2 which shows a side view of an exercising device quite similar to that of FIG. 1 except that motor means 48 and inclination means 50 have been added. The motor 48 is connected to wheel 52 by belt 54. Rotation of the wheel, which may be a sprocket wheel, drives the endless belt 14. As is well known, the speed of the motor can be controlled so that the belt 14 moves at the speed selected by the jogger. An inclination means 50 is also provided so that the front end of the treadmill 10 can be lifted to give the desired inclination. This includes a lift jack 56 with a base 58 and a frame 59 which rotates about pivot 61. As shown in FIG. 3 jack 56 pushes down through cross member 60 to contacts or wheels 58. By using jacks 56 the treadmill 14 can be inclined as indicated in FIG. 5. In FIG. 2 the exerciser is lifting up on handle grip 30 while moving along the treadmill at a selected speed. Moving along the treadmill gives the exerciser the aerobic conditioning and the lifting up on handle grips 30 exercises a different group of muscles from that being exercised in FIG. 1.

Attention is next directed to FIG. 5 which shows the treadmill inclined and also shows a means other than weight of applying the downward force to the upper body muscle exercising means 18. This includes a hydraulic/pneumatic cylinder 70 which is connected between handlebar 26 and frame 16. There would be one of these also for handlebar 24. The force required to lift this cylinder can be adjusted using well known principles. A spring could also be used in place of cylinder 70.

Figure 7:
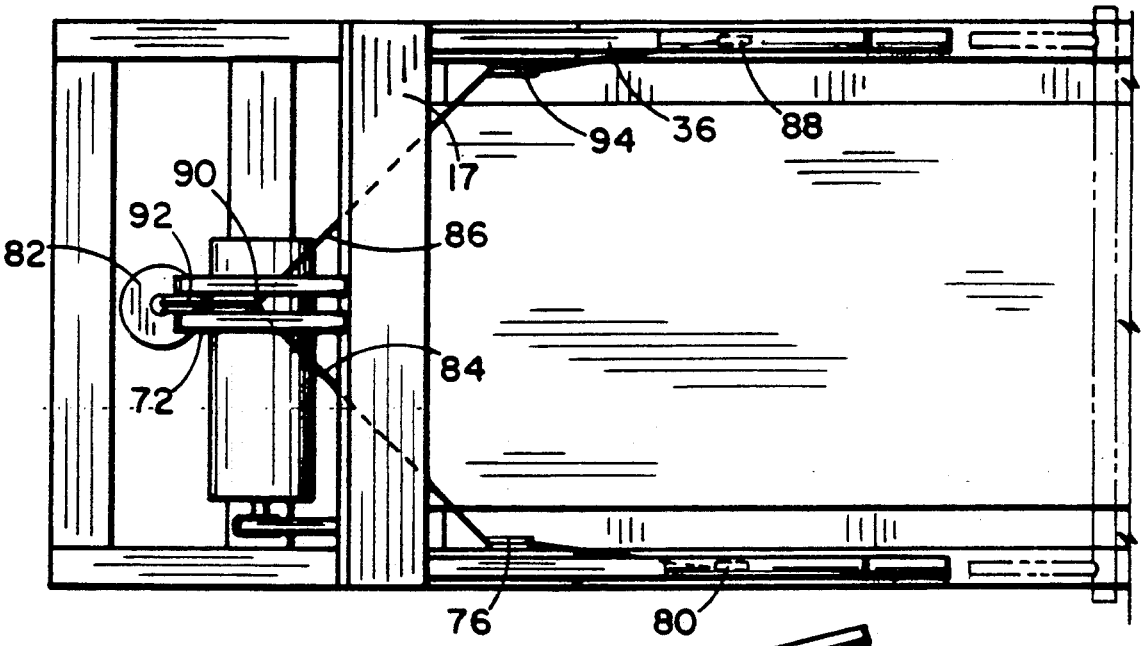
FIG. 7 is a plan view of the device of FIG. 6.

Attention is next directed to FIGS. 6 and 7 which show another means of supporting the weights. This includes an extension arm 72 secured to the top of frame 16. A pulley 74 is mounted at the end of extension arm 72. A second pulley 76 is mounted on one side of support 16 and pulley 94 is mounted on the other side as shown in FIG. 7. As shown in FIG. 7 there is in effect a first line segment 84 which connects to handlebar 26 and 80 extends down under pulley 76 and a second line segment 86 which connects to point 88 on handlebar 24 and extends down under pulley 94. The two segments 84 and 86 come together at point 90 and connect to a single or terminal segment 92 which extends over pulley 74 down to weights 82. By varying the weight 82 one would vary the vertical force required to lift handlebar 26.

It is thus seen that I have described a treadmill exercising machine combined with an upper body strengthening device whereby I can simultaneously obtain both a physical conditioning known as aerobic and the upper body muscle building device which includes isokinetic loading. I can use different parts of my upper body strengthening device to exercise different sets of upper body muscles. I can adjusts the inclination of the treadmill to vary the required effort for a particular load condition.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. Apparatus to simultaneously exercise human upper body and lower body muscles and provide cardio-pulmonary benefits, comprising:

a treadmill;

a lower base for supporting the treadmill;

an upwardly extending support frame affixed at a forward end of said lower base;

a lever means supported about a pivotal axis that is adjacent a top of said support frame, said lever means being pivotal upwardly from an inactive position and comprised of spaced and parallel handlebars each of which extends, while in said inactive position, substantially horizontally rearwardly from said pivotal axis;

a handle grip on said handlebars;

a stop means connected to said lever means to contact said support frame when said lever means is in said inactive position; and means connected to said handlebars to apply a normally downward force to said lever.

2. Apparatus to claim 1 wherein said means to apply a normally downward force is a fluid operated piston/-cylinder means.

3. Apparatus according to claim 1 wherein said means to apply a normally downward force is a spring means.

4. Apparatus according to claim 1 wherein said means to a normally downward force comprises weights supported by said lever means.

5. An exercising device as defined in claim 2 including means to vary the inclination of the treadmill.

* * * * *